United States Patent [19]

Nelson

[11] Patent Number: 4,493,623

[45] Date of Patent: Jan. 15, 1985

[54] OIL LUBRICATED MAIN DRIVE SHAFT FOR FUEL PUMP

[75] Inventor: James C. Nelson, Tolland, Conn.

[73] Assignee: Chandler Evans Inc., West Hartford, Conn.

[21] Appl. No.: 468,066

[22] Filed: Feb. 22, 1983

[51] Int. Cl.[3] ..... F04C 1/08

[52] U.S. Cl. ..... 418/94; 418/206; 417/372; 417/368

[58] Field of Search ..... 418/94, 206; 417/372, 417/368, 366; 184/6-16, 7 R, 8

[56] References Cited

FOREIGN PATENT DOCUMENTS

| | | | |
|---|---|---|---|
| 531205 | 9/1954 | Belgium | 418/94 |
| 676730 | 5/1939 | Fed. Rep. of Germany | 418/94 |
| 2901428 | 7/1979 | Fed. Rep. of Germany | 418/206 |
| 137668 | 8/1982 | Japan | 417/372 |
| 464476 | 4/1936 | United Kingdom | 418/94 |
| 445878 | 5/1936 | United Kingdom | 418/94 |

*Primary Examiner*—William R. Cline

*Assistant Examiner*—John J. McGlew, Jr.

*Attorney, Agent, or Firm*—Radford W. Luther; Richard A. Dornon

[57] ABSTRACT

A drive shaft (26) of a gear type fuel pump (2) forms a driving interconnection between an engine gearbox (4) and a shaft (14) which carries the driving gear (10) of the fuel pump. The drive shaft has a slightly diverging lubricant supply passage (65) which receives lubricant from an oil jet (70) in the engine gearbox and directs the lubricant to the engaged splines (44, 46) at the inboard end of the drive shaft. Lubricant from the area of spline engagement is returned to the gearbox via radial passage (78), annular lubricant return passage (68) and radial passage (80). O-ring seals (82, 84) on the drive shaft, which straddle a drain passage (86) prevent the mixing of the lubricant and the fuel which may envelop an intermediate portion of the drive shaft. Wear of the engaged, oil lubricated splines (40, 42) at the outboard end of the drive shaft should provide a general indication of spline wear at the inboard end of the drive shaft because both ends are exposed to similar lubrication.

4 Claims, 1 Drawing Figure

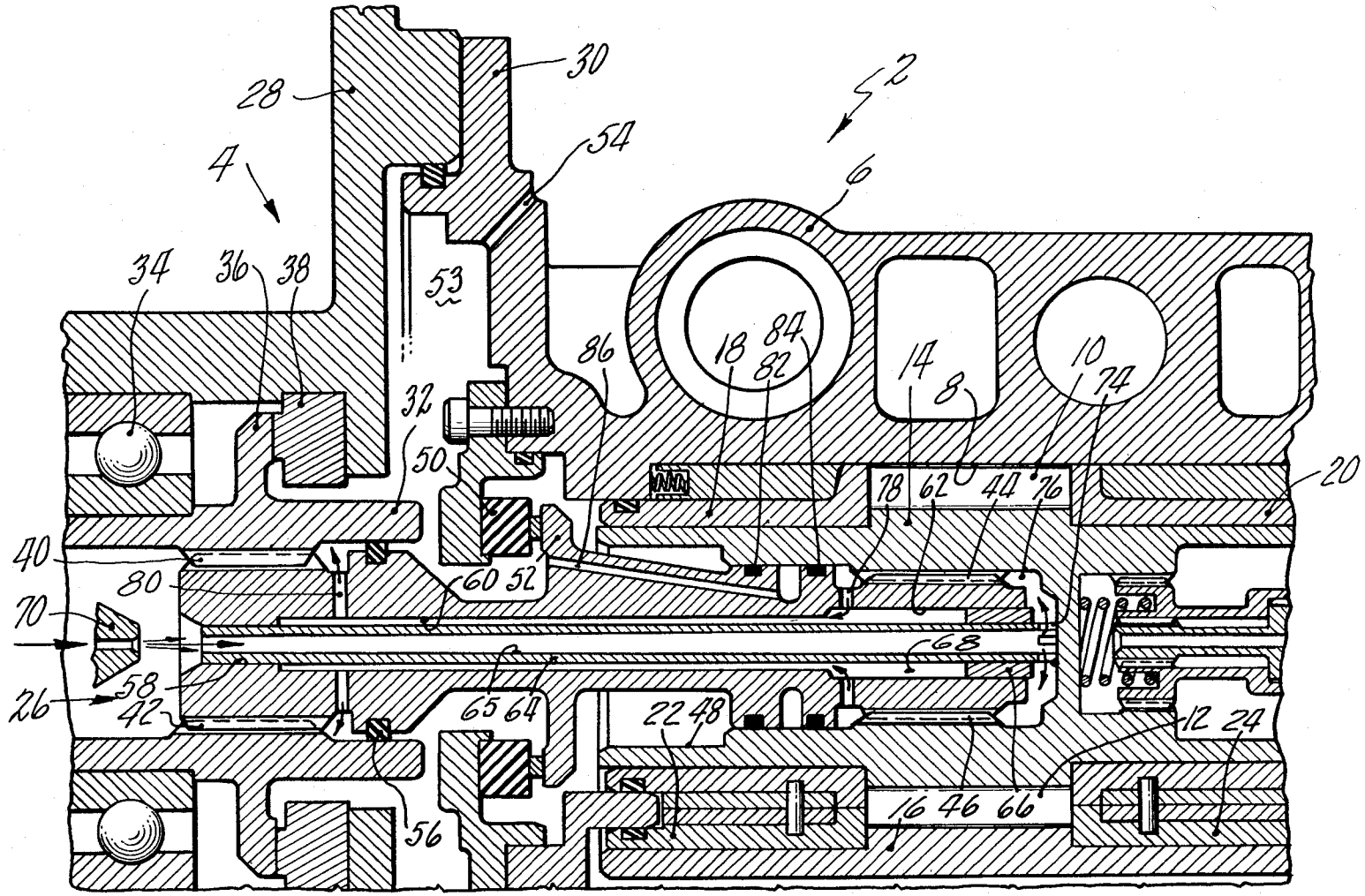
2
4
6
8
10
12
14
16
18
20
22
24
26
28
30
32
34
36
38
40
42
44
46
48
50
51
52
53
54
56
58
60
62
64
65
66
68
70
72
74
76
78
80
82
84
86

OIL LUBRICATED MAIN DRIVE SHAFT FOR FUEL PUMP

TECHNICAL FIELD

This invention relates to fuel pump drive shafts.

BACKGROUND ART

Fuel pump main drive shafts typically incorporate a spline at each end. The spline at the outboard end is connected to the engine gearbox while the spline at the inboard end is connected to a rotating pump component. While the spline attached to the engine gearbox is lubricated by oil, the spline at the other end is lubricated by less lubricous fuel, thereby resulting in unequal spline wear. The basic problem is that observation of spline wear at the readily accessible outboard end of the shaft provides no indication of spline wear at the inaccessible inboard end, whereby actual inspection is necessary to ascertain the extent of wear at the inboard end.

DISCLOSURE OF THE INVENTION

In accordance with the invention, equal lubrication is furnished at both ends of a fuel pump main shaft without requiring the imposition of weight and space penalties.

Succinctly stated, a main drive shaft in a fuel pump incorporates conduits and passages which transport lubricating oil from the engine gearbox to the inboard spline, and thence, back to the gearbox. The drive shaft embodies seal means to separate the oil adjacent to the inboard spline from the fuel.

Accordingly, it is a primary object of the invention to provide a fuel pump having a main drive shaft with both ends lubricated by oil.

This and other objects and advantages of the invention will become more readily apparent from the following detailed description when taken in conjunction with the accompanying drawings, in which:

BRIEF DESCRIPTION OF DRAWINGS

The drawing shows a sectional side elevational view of a fuel pump incorporating the invention.

BEST MODE OF CARRYING OUT THE INVENTION

Referring to the drawing, there is shown a gear pump, generally designated 2, incorporating the invention. The pump 2 is adapted to supply fuel to a gas turbine engine (not shown) having a gearbox, generally indicated at 4. The pump 2 has a housing 6 which defines a pumping cavity 8 in which a pair of meshing gears 10 and 12 are contained. The gears 10 and 12 are respectively carried by integral shafts 14 and 16 which are, in turn, supported for rotation by bearings 18, 20 and 22, 24, respectively. Gear 10 is the driving gear and gear 12 is the driven gear. A main drive shaft, generally indicated at 26, forms a driving interconnection between the engine gearbox 4 and the shaft 14 which carries the driving gear 10.

The gearbox 4 has a flange 28 which is connected to a flange 30 on the pump housing 6 by a series of bolts. A drive shaft 32 is rotatably mounted within the engine gearbox 4 by bearings, such as shown at 34. The drive shaft 32 incorporates an integral flange 36 which is in wiping engagement with a carbon faced seal 38 adapted to isolate any fuel which may be present between the pump housing 6 and the gearbox from the bearings 34. The gearbox drive shaft 32 is provided with a plurality of internal splines 40 which are in driving engagement with a plurality of external splines 42 on the outboard end of the pump main drive shaft 26. The inboard end of the main drive shaft 26 has similar external splines 44 which are in driving engagement with a plurality of internal splines 46 formed within an elongated cavity 48 in the shaft 14.

Within the pump housing 6, a carbon faced seal 50 is mounted in engagement with a flange 52 on the main drive shaft 26 for preventing fuel in the pumping cavity 8 from entering the volume defined 53 between the pump housing 6 and the gearbox 4. This volume 53, which is usually empty, communicates with an overboard drain 54. Should fuel leak into this volume it will be evacuated to the atmosphere via the overboard drain 54. An O-ring seal 56 disposed in an annular recess in the main drive shaft 26 contacts the inner surface of the gearbox drive shaft 32, whereby oil in the gearbox is sealed from the volume which communicates with the overboard drain. It will be appreciated that the pump 2 and gearbox 4 are generally conventional insofar as these elements have been described.

The main drive shaft 26 embodies a hollow interior essentially constituted by three bores 58, 60 and 62 of progressively increasing diameters. A lubrication tube 64 having a lubricant supply passage 65 is disposed within the hollow interior of the shaft 26 with its outer periphery in close fitting engagement with the bore 58 and a bushing 66 at the inboard end of the main drive shaft 26. Surrounding the tube 64 is defined an annular lubricant return passage 68. Lubricating oil is supplied to the tube 64 at its inlet or outboard end via an oil jet 70 (at a slightly higher pressure than the surrounding area) in the engine gearbox 4 which has its axis aligned with that of the tube 64. The inboard or outlet end of the tube 64, which bears against a transverse wall 72 at the base of cavity 48 in the shaft 14, has a plurality of circumferentially distributed slots 74 through which oil is radially directed into a space 76 between the inboard end of the shaft 26 and the adjacent walls of the cavity 48. Oil from the space 76 enters the area of engagement between splines 44 and 46, providing lubrication which has heretofore been accomplished by fuel. In order to facilitate the flow of oil through the tube 64, the interior passage thereof preferrably has a progressively increasing diameter, thereby defining a truncated conical shape. Such a configuration provides something akin to centrifugal pumping action.

A return path for the oil in the area of spline engagement is provided by a plurality of radially extending passages 78 in the shaft 26 which communicate with the outer end of this area and the annular passage 68. Another series of radially extending passages 80 fluidly interconnect the annular passage 68 and a volume adjacent to the outer periphery of the shaft 26 located between the seal 56 and the splines 40 and 42. Oil from this latter mentioned area proceeds back into the gearbox 4 through the splines 40 and 42.

In order to prevent the fuel which envelops the intermediate portion of the shaft 26 inboard of the flange 52 from contaminating the oil in the area of engagement between splines 44 and 46, a seal must be provided. To this end, O-ring seals 82 and 84 are mounted in annular recesses on the shaft 26 in sealing contact with the wall of the cavity 48. A drain passage 86, which connects the outer periphery of the shaft 26 lying between the seals 82 and 84 and the volume 53 insures that fuel leaking past the seal 82 will not contaminate the oil but will instead proceed into volume 53. In like manner, any oil leaking past the seal 84 will not mix with fuel but will proceed to the volume 53 through the drain passage 86.

In operation, oil proceeds from the jet 70 into the inlet of the tube 64. Oil passing through the tube emerges through the slots 74 into the space 76 from where it enters the area of engagement between the splines 44 and 46. Oil from the splines 44 and 46 travels back to the gearbox 4 through passages 78, 68 and 80. Should either fuel or oil leak past the respective 0-ring seals 82 and 84, it will be transferred to the volume 53 via the drain passage 86.

Obviously, many variations and modifications are possible in light of the above teachings without departing from the scope or spirit of the invention as defined in the appended claims.

I claim:

1. In an improved fuel pump adapted to be connected to the gearbox of an engine, the pump being of the type comprising a housing having a pumping cavity therein, a rotating pump component mounted in the pumping cavity and a drive shaft having its outboard and inboard ends in respective engagement with the gearbox and the rotating pump component, the improvement comprising:

lubricant supply passage means for directing lubricant from the gearbox through the drive shaft to the inboard end thereof;

lubricant return passage means for directing lubricant adjacent to the inboard end of the drive shaft back through the drive shaft to the gearbox;

a pair of spaced seals circumferentially mounted upon the drive shaft in engagement with the rotating component; and a drain passage in the drive shaft communicating with the outer periphery of the drive shaft at a location between the seals.

2. The improvement of claim 1, wherein the lubricant supply passage means comprises:

a tube, having a lubricant supply passage, mounted in the drive shaft such that at least a portion of its outer periphery is radially spaced from the drive shaft so as to form an annular passage, and wherein the lubricant return passage means comprises:

the annular passage;

a plurality of radial passages in the drive shaft adjacent to the inboard end thereof in communication with the annular passage; and a plurality of radial passages in the drive shaft adjacent to the outboard end thereof in communication with the annular passage.

3. The improvement of claim 2, wherein the lubricant supply passage has a progressively increasing diameter in the direction of the inboard end of the drive shaft to facilitate the flow of lubricant therethrough.

4. A method of lubricating the inboard end of a fuel pump drive shaft in engagement with a rotating pump component comprising the steps of:

providing a pair of spaced circumferential seals between the outer periphery of the drive shaft and the rotating pump component;

directing the supply flow lubricant through a tube mounted in the drive shaft to the inboard end;

directing the return flow of lubricant from the inboard end over the outer periphery of the tube in a direction opposite to that of the supply flow; and draining off any fuel or lubricant leaking between the seals to prevent any mixing of lubricant and fuel.

* * * * *